United States Patent [19]

Hasegawa

[11] 4,203,528

[45] May 20, 1980

[54] SELF-STORING PULL STRIP FOR EASY OPENING CONTAINERS

[75] Inventor: Gary K. Hasegawa, Chicago, Ill.

[73] Assignee: The Continental Group, Inc., New York, N.Y.

[21] Appl. No.: 34,327

[22] Filed: Apr. 30, 1979

[51] Int. Cl.[2] ..... B65D 41/32

[52] U.S. Cl. ..... 220/269; 220/339; 220/375

[58] Field of Search ..... 220/269, 270, 339, 375, 220/379

[56] References Cited

U.S. PATENT DOCUMENTS

| | | | |
|---|---|---|---|
| 3,813,000 | 5/1974 | Underwood | 220/269 |
| 3,847,300 | 11/1974 | Waters | 220/269 |

*Primary Examiner*—George T. Hall

*Attorney, Agent, or Firm*—Charles E. Brown

[57] ABSTRACT

This disclosure relates to a pull strip which is molded of plastics material to have hinge sections with a memory so that a strap portion thereof will automatically fold upon itself in such a manner that the removable panel portion attached thereto and removed therewith will be automatically swung to a position radially beyond the end unit and then down alongside the container in a stored, out-of-the-way position.

10 Claims, 3 Drawing Figures

10
12
14
16
18
20
22
24
26
28
30
32
34
36
38
40
42
44
46
48
50
52
54
2

SELF-STORING PULL STRIP FOR EASY OPENING CONTAINERS

This invention relates in general to new and useful improvements in easy opening containers, and more particularly to an easy opening container which includes a pull strip which is permanently attached to a removable panel portion and which is formed with a memory wherein, after the removal of the panel portion, the pull strip automatically folds back upon itself and stores the removed panel portion alongside the associated container body.

For many years easy opening containers were constructed with the pull tab or strip secured solely to the removable panel portion so that once the container was opened the removable panel portion and attached pull tab were free to be discarded. Unfortunately, the removed panel portion has a sharp edge which could easily cut someone if stepped upon or otherwise improperly handled.

Easy opening containers have been constructed wherein the panel portion which is removed from the end panel of the container is merely displaced but is never detached from the container. This eliminates the problem of the loose removed panel portion and pull tab, but creates another problem in that it results in the previously exposed to the public surface of the displaceable panel portion being forced into the interior of the container to be associated with the product stored therein under sterile conditions.

The pull strip of this invention serves to overcome the deficiencies of both arrangements described above. The removable panel portion is fully removed from the container panel and the pull strip is so constructed as to have a memory which results in the automatic folding of the strap portion thereof when the grip end of the pull strip becomes free at the end of the panel portion removal operation.

Most particularly, this invention has to do with a pull strip which includes a securing portion disposed in overlying relation to the removable panel portion and of a configuration corresponding to the outline of the removable panel portion to form a mask. The securing portion has formed therewith an elongated strap portion which is provided with selected transverse hinge means having a memory so that when the end of the strap portion remote from the securing portion is permanently secured to the container panel and the removable panel portion is removed, the strap portion will first hinge upon the anchored part thereof so as to move the securing portion and the removed panel portion radially outwardly of the peripheral seam of the container and the further hinge means will move the securing portion and removed panel portion tightly against the side of the body of the container to a stored position.

With the above and other objects in view that will hereinafter appear, the nature of the invention will be more clearly understood by reference to the following detailed description, the appended claims, and the several views illustrated in the accompanying drawings.

IN THE DRAWINGS

Figures 1, 2, 3:
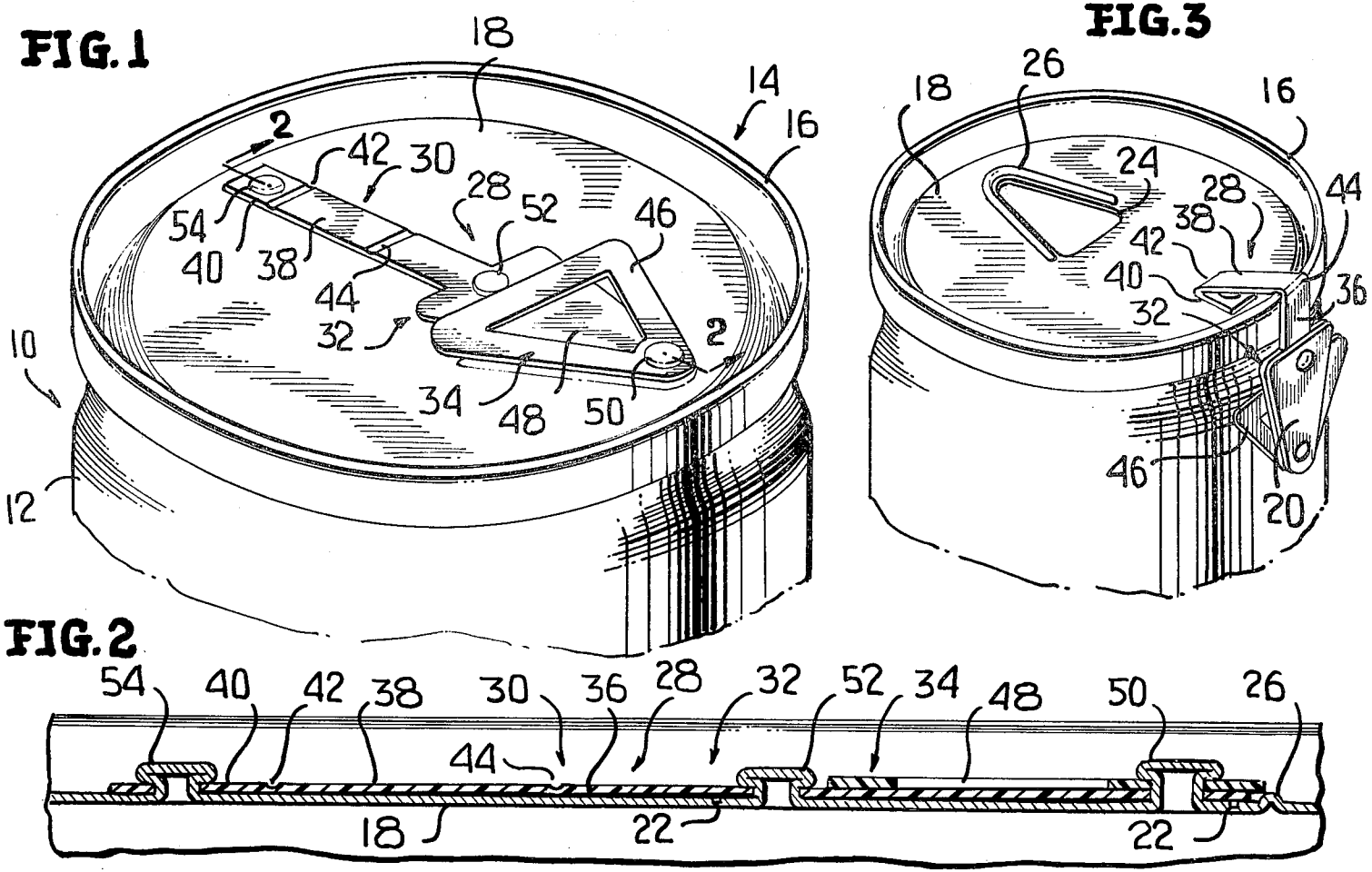
FIG. 1 is a top plan view of an easy opening end unit formed in accordance with this invention and secured to a can body.
FIG. 2 is an enlarged vertical sectional view taken generally along the line 2—2 of FIG. 1, and shows more specifically the details of the pull strip and the relationship thereof to the end panel.
FIG. 3 is a top perspective view of the end unit of FIG. 1 rotated 180° about the axis of the container body and showing the container in its fully opened state with the removed panel portion stored alongside the container body.

Referring now to the drawings in detail, it will be seen that there is illustrated in FIG. 1 an easy opening container or can generally identified by the numeral 10. The container 10 includes a body 12 which has secured to the upper end thereof an end unit, generally identified by the numeral 14, by means of a conventional peripheral seam 16. The end unit 14 includes an end panel 18 which basically forms the end wall of the container 10. The end panel 18 has formed therein a removable panel portion 20 of a generally triangular outline by means of a line of weakness 22 which may be in the form of a score.

If desired, as is best shown in FIG. 3, the portion of the end panel 18 surrounding a dispensing opening 24 which is formed by the removal of the panel portion 20, may be in part bounded by an upstanding rib 26 so as to prevent the contact of one's lips with the raw edge of the dispensing opening 24.

This invention relates to the removal and storage of the panel portion 20. The removal and storage of the panel portion 20 is facilitated by means of a pull strip which is generally identified by the numeral 28. The pull strip 28 includes an elongated strap portion 30, a securing portion 32 and a grip portion 34. In the illustrated embodiment of the pull strip 28, the grip portion 34 is formed separately and apart from the remainder of the pull strip although it is feasible that it may be integrally formed with the securing portion 32.

First of all, the securing portion 32, like the removable panel portion 20, is of a generally triangular outline and corresponds generally in size to the panel portion 20 although, if desired, the securing portion 32 may be slightly larger than the panel portion 20 so as completely to mask the panel portion 20 when it is removed.

The strap portion 30 is integrally connected to the base of the securing portion 32 and includes an extension part 36 which extends directly from the securing portion 32 as a continuation thereof. The strap portion 30 also includes an intermediate part 38 and an anchoring part 40. The anchoring part is separated from the intermediate part by transverse hinge means 42 which is a molded area having a memory. Similar hinge means 44 connects the intermediate part 38 to the extension part 36.

The pull strip 28 is molded of plastics so that the means 42 and 44 have a memory which, when the strap portion 30 is released, will cause automatic folding of the parts thereof substantially 180° upon themselves for an advantageous purpose as will be described in detail hereinafter.

The grip portion 34 includes a generally triangular peripheral part 46 defining a central opening 48 to receive one's fingers so as to facilitate the gripping of the grip portion 34. The grip portion 34 has a wider base then the securing portion 32 and thus extends generally to opposite sides of the securing portion 32 although it is in overlying relation thereto.

As pointed out above, the grip portion 34, while it is illustrated as being separately formed from the securing portion 32, may be integral therewith. However, in the illustrated embodiment of the invention, a single rivet 50 or other fastening means carried by a starting part of the removable panel portion 20 secures the nose of the securing portion 32 and the nose of the grip portion 34 together and to the panel portion 20. Because the removed panel portion 20 is to be tightly secured to the securing portion 32, a second rivet 52 or other type of fastener secures the base part of the securing portion 32 to the panel portion 20.

Finally, a third rivet 54 or other securing means fixedly secures the anchoring part 40 to the end panel 18. Thus the pull strip 28 with the removed panel portion 20 attached thereto will remain permanently secured to the end panel 18 after opening of the container 10.

Referring now to FIG. 3, it will be seen that after the panel portion 20 has been removed and the pull strip 28 released, the hinge means 42 will effect folding of the intermediate part 38 back upon the anchoring part 40 with the extension part 36 extending outwardly beyond the peripheral seam 16. The position of the anchoring part 40 on the end panel 18 and the dimensions thereof and the dimensions of the intermediate part 38 are such that the hinge means 44 is substantially aligned with the peripheral seam 16 when the intermediate part 38 comes to rest after folding relative to the anchoring part 40.

At the same time the memory of the hinge means 44 causes folding or hinging of the extension part 36 so as to bring the grip portion 34 into tight contact with the exterior surface of the body 12, as is clearly shown in FIG. 3. This results in a like manner the securing portion 32 and the removed panel portion 20 being disposed closely adjacent the container body 12 in a stored, out-of-the-way position.

The automatic movement and retention of the pull strip 28 and the removed panel portion 20 away from the dispensing opening 24 permits the product in the container 10 to be readily dispensed including the direct drinking of a liquid from the container. At the same time, the raw edge of the removed panel portion 20 is masked by the securing portion 32 so that accidental cutting of one is substantially eliminated.

Although only a preferred embodiment of the invention has been illustrated and described herein, it is to be understood that minor variations may be made in the pull strip and its securement to the container end unit without departing from the spirit and scope of the invention as defined by the appended claims.

I claim:

1. A pull strip for use in an easy opening container having a removable panel portion, said pull strip comprising an elongated strap portion, a securing portion and a grip portion; said strip portion being narrower than said securing portion and being divided into a terminal anchoring part, an intermediate part and an extension part by transverse hinge means each having a memory automatically operable to effect a folding of said parts of said strip portion from a planar state towards reversely folded portions.

2. The pull strip of claim 1 wherein said intermediate part is materially longer than said anchoring part.

3. The pull strip of claim 2 wherein said extension part is a direct continuation of said securing portion and remains substantially coplanar therewith.

4. The pull strip of claim 2 wherein said grip portion is separately formed.

5. The pull strip of claim 1 wherein said securing portion has two rivet openings and said anchoring part has at least one rivet opening, said rivet openings being in alignment.

6. A pull strip according to claim 1 wherein said pull strip is part of a container end unit including a removable panel portion, said securing portion overlies and is secured to said removable panel portion, said securing portion being of an outline corresponding to the outline of said removable panel portion and aligned therewith, and said anchoring part is fixedly secured to said end unit remote from said removable panel portion.

7. The pull strip of claim 6 wherein said end unit is secured to a can body by a peripheral seam, and the portion of said anchoring part relative to said seam and the length of said intermediate part is such that when said removable panel portion is removed said hinge means between said intermediate part and said extension part overlies said seam and said extension part, said securing portion, said grip portion and said removed removable panel portion depend alongside said can body.

8. The pull strip of claim 6 wherein said securing portion is secured to said removable panel portion by a pair of fasteners spaced longitudinally of said pull strip.

9. The pull strip of claim 8 wherein said removable panel portion has a starting end, one of said fasteners is adjacent said starting end, said grip portion is separately formed, and said one fastener secures said grip portion to said securing portion and said removable panel portion.

10. The pull strip of claim 9 wherein said grip portion is of a lesser longitudinal extent than said securing portion and termianting short of said second fastener.

* * * * *